US012808106B2

(12) United States Patent
Kwon et al.

(10) Patent No.: US 12,808,106 B2
(45) Date of Patent: Nov. 24, 2026

(54) STACK-TYPE LAUNDRY TREATING APPARATUS

(71) Applicant: LG Electronics Inc., Seoul (KR)

(72) Inventors: Daehan Kwon, Seoul (KR); Donghyun Jin, Seoul (KR); Sangho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1532 days.

(21) Appl. No.: 17/193,688

(22) Filed: Mar. 5, 2021

(65) Prior Publication Data

US 2021/0277559 A1 Sep. 9, 2021

(30) Foreign Application Priority Data

Mar. 5, 2020 (KR) ..... 10-2020-0027778
Oct. 14, 2020 (KR) ..... 10-2020-0132544

(51) Int. Cl.
*D06F 29/00* (2006.01)
*D06F 23/02* (2006.01)
(Continued)

(52) U.S. Cl.
CPC ..... *D06F 29/005* (2013.01); *D06F 23/02* (2013.01); *D06F 37/30* (2013.01); *D06F 39/125* (2013.01); *D06F 58/08* (2013.01); *D06F 58/26* (2013.01)

(58) Field of Classification Search
CPC ..... D06F 29/00; D06F 29/005; D06F 39/12; D06F 39/125
See application file for complete search history.

(56) References Cited

U.S. PATENT DOCUMENTS 3,555,701 A * 1/1971 Hubband ..... D06F 58/02 34/602
6,874,248 B2 * 4/2005 Hong ..... D06F 58/08 248/677
(Continued)

FOREIGN PATENT DOCUMENTS

CN 1517477 8/2004
CN 1721713 1/2006
(Continued)

OTHER PUBLICATIONS

Office Action in Chinese Appln. No. 202110213490.3, mailed on May 17, 2023, 14 pages (with English translation).
(Continued)

*Primary Examiner* — Benjamin L Utech
(74) *Attorney, Agent, or Firm* — Fish & Richardson P.C.

(57) ABSTRACT

A stack-type laundry treating apparatus includes upper and lower treating apparatuses. The upper treating apparatus includes an upper cabinet including an upper base, a drying drum, an upper driver disposed on the upper base for rotating the drying drum, an air flow path for supplying and discharging air to and from the drying drum, and a heat-exchanger for dehumidifying and heating the air. The lower treating apparatus includes a lower cabinet including a lower top panel on which the upper base is mounted, a tub disposed in the lower cabinet, a washing drum disposed inside the tub, and a lower driver for rotating the washing drum. A support protrusion extends horizontally and outwardly from a bottom portion of the upper base to support the upper cabinet with respect to the lower cabinet.

21 Claims, 9 Drawing Sheets

(51) Int. Cl.

| | |
|---|---|
| ***D06F 37/30*** | (2020.01) |
| ***D06F 39/12*** | (2006.01) |
| ***D06F 58/08*** | (2006.01) |
| ***D06F 58/26*** | (2006.01) |

(56) References Cited

U.S. PATENT DOCUMENTS

| | | | | |
|---|---|---|---|---|
| 2006/0010934 | A1 | 1/2006 | Kim | |
| 2009/0145177 | A1* | 6/2009 | Kim | D06F 39/125 68/13 R |
| 2011/0079053 | A1 | 4/2011 | Park et al. | |
| 2014/0208609 | A1* | 7/2014 | Han | D06F 29/005 34/130 |
| 2014/0366283 | A1 | 12/2014 | Jun et al. | |
| 2017/0022653 | A1* | 1/2017 | Buso | D06F 58/52 |
| 2018/0340286 | A1 | 11/2018 | Kim et al. | |

FOREIGN PATENT DOCUMENTS

| | | | |
|---|---|---|---|
| CN | 101037838 | A | 9/2007 |
| CN | 200988922 | | 12/2007 |
| CN | 104903508 | A | 9/2015 |
| CN | 107587312 | A | 1/2018 |
| CN | 107587313 | | 1/2018 |
| CN | 107815821 | A | 3/2018 |
| CN | 107012648 | | 6/2019 |
| CN | 110158291 | A | 8/2019 |
| EP | 2703536 | | 3/2014 |
| EP | 2873764 | A1 | 5/2015 |
| EP | 3521501 | | 8/2019 |
| JP | 2010000107 | | 1/2010 |
| KR | 20060005849 | | 1/2006 |
| KR | 20100020628 | | 2/2010 |
| KR | 10-2018-0105370 | A | 9/2018 |
| WO | WO2018040840 | | 3/2018 |
| WO | 2019/034060 | A1 | 2/2019 |

OTHER PUBLICATIONS

Extended European Search Report in European Appln. No. 21159269.6, dated Jul. 29, 2021, 11 pages.

Office Action in Chinese Appln. No. 202110213490.3, dated Sep. 1, 2022, 14 pages (with English translation).

Notice of Allowance in Chinese AppIn. No. 202310961387.6, mailed on Nov. 28, 2025, 8 pages (with English translation).

Notice of Allowance in Chinese Appln. No. 202310961472.2, mailed on Jul. 29, 2026, 10 pages (with English translation).

* cited by examiner

STACK-TYPE LAUNDRY TREATING APPARATUS

CROSS-REFERENCE TO RELATED APPLICATIONS

This application claims the benefit of Korean Patent Applications No. 10-2020-0027778, filed on Mar. 5, 2020, and No. 10-2020-0132544, filed on Oct. 14, 2020, the disclosures of which are hereby incorporated by reference as when fully set forth herein.

TECHNICAL FIELD

The present disclosure relates to a stack-type laundry treating apparatus, and more specifically, relates to a stack-type laundry treating apparatus that includes a plurality of treating apparatuses, such as an upper treating apparatus and a lower treating apparatus, that can be stacked vertically to increase space utilization and further make it easy to manipulate the plurality of treating apparatuses.

BACKGROUND

A laundry treating apparatus may be classified into a front-loading type laundry treating apparatus and a top-loading type laundry treating apparatus according to a manner that receives laundry. Depending on a manner that treats laundry, the laundry treating apparatus may be classified into a washing apparatus for washing the laundry and a drying apparatus for drying the laundry.

The front-loading type washing apparatus may provide a reduced overall height and increased washing capacity, compared to the top-loading type washing apparatus. The top-loading type washing machine may have an inner tub that stands upright and can rotate as a washing tub. In the front-loading type washing apparatus, twisting of the laundry hardly occur. Thus, demand of the front-loading type washing apparatus is increasing.

The front-loading type washing apparatus includes a tub disposed inside a cabinet defining an appearance thereof, a drum rotatable inside the tub, and a driver that rotates the drum. The rotation of the drum may cause friction between the drum, a washing-water, and an object to be washed (laundry), thereby removing contaminations from the laundry.

Further, some drying apparatuses have an appearance similar to that of the front loading type washing apparatus. Such drying apparatuses include a drying drum rotatable inside a cabinet, a driver that rotates the drying drum, and a hot air supply that supplies hot and dry air into the drum, thereby drying the laundry in a wet state after washing thereof is completed.

When the washing apparatus and the drying apparatus described above are installed at the same time, the washing apparatus and the drying apparatus are installed side by side in a horizontal direction relative to an installation surface.

However, when an installation space is narrow, the washing apparatus and the drying apparatus may be individually installed in separate spaces. Thus, after having been washed in the washing apparatus, the laundry needs to be carried to the drying apparatus to be dried.

Some washing apparatuses are designed to have a mount face or a mounting part for installing a drying apparatus thereon so that the drying apparatus may be stacked on a top of the washing apparatus.

However, as described above, when the washing apparatus and the drying apparatus are stacked vertically, it is very difficult to fix the drying apparatus at a correct position on the mount face of the washing apparatus. Thus, without a separate fixing device, the drying apparatus may be dislocated from the correct installation position when the drying apparatus operates on the washing apparatus.

Further, if the washing apparatus provides a separate mounting part for stacking the drying apparatus on the washing apparatus, the installation process may be cumbersome because of several steps to perform, such as fixing the separate installation part to the washing apparatus, and then disposing the drying apparatus on the washing apparatus, and then fixing the washing apparatus with the drying apparatus via the mounting part.

Therefore, a stacking structure of the washing apparatus and the drying apparatus should be improved such that the drying apparatus may be stacked on and fixed to the washing apparatus more conveniently.

SUMMARY

To solve the above problems and other problems, some implementations of the present disclosure provide a stack-type laundry treating apparatus in which an upper treating apparatus may be stacked on a top of a lower treating apparatus.

Some implementations of the present disclosure provide a stack-type laundry treating apparatus including means which is disposed between the lower treating apparatus and the upper treating apparatus, and limits a position of the upper treating apparatus.

Some implementations of the present disclosure provide a stack-type laundry treating apparatus in which a position of the upper treating apparatus may be corrected when the upper treating apparatus is stacked on the lower treating apparatus.

Purposes of the present disclosure are not limited to the above-mentioned purpose. Other purposes and advantages of the present disclosure as not mentioned above may be understood from following descriptions and more clearly understood from implementations of the present disclosure. Further, it will be readily appreciated that the purposes and advantages of the present disclosure may be realized by features and combinations thereof as disclosed in the claims.

Particular implementations of the present disclosure provide a stack-type laundry treating system that includes upper and lower treating apparatuses. The upper treating apparatus may include an upper cabinet, a drying drum, an upper driver, an air flow passage, and a heat-exchanger. The upper cabinet may include an upper base. The drying drum may be disposed in the upper cabinet and configured to rotate. The drying drum may be configured to receive an object to be dried. The upper driver may be disposed at the upper base and configured to rotate the drying drum. The air flow passage may be configured to supply air to and discharge air from the drying drum. The heat-exchanger may be configured to dehumidify and heat air that is supplied to and discharged from the drying drum. The lower treating apparatus may include a lower cabinet, a tub, a washing drum, and a lower driver. The lower cabinet may include a lower top panel at which the upper base is mounted. The tub may be disposed in the lower cabinet and configured to receive washing-water. The washing drum may be disposed inside the tub and configured to receive an object to be washed. The lower driver may be configured to rotate the washing drum. The upper base may include a support protrusion that is located at a bottom portion of the upper base and supports the upper cabinet with respect to the lower cabinet.

In some implementations, the system can optionally include one or more of the following features. The upper cabinet may have an upper side panel. The lower cabinet may have a lower side panel. The support protrusion may be interposed between the upper side panel and the lower side panel and supports the upper treating apparatus. The upper side panel may include an upper horizontal bent portion horizontally extending from a bottom of the upper side panel toward an inside of the upper treating apparatus. The support protrusion may be disposed at an inside of the upper horizontal bent portion. The upper side panel may include a vertical bent portion extending upward from an end of the upper horizontal bent portion, and a base support portion extending from an end of the vertical bent portion to an upper portion of the support protrusion. The support protrusion may be positioned at the base support portion. The lower top panel may have a support face that is interposed between the lower side panel and the support protrusion and supports the support protrusion. The lower side panel may have a lower horizontal bent portion horizontally extending from a top of the lower side panel toward an inside of the lower treating apparatus. The support face of the lower top panel may be disposed at the lower horizontal bent portion of the lower side panel. The upper horizontal bent portion of the upper side panel and the lower horizontal bent portion of the lower side panel may be spaced from each other by a first distance. A reinforcing frame is disposed at the top of the lower side panel. The reinforcement frame may include (i) a horizontal frame disposed at a top face of the lower horizontal bent portion and (ii) a vertical frame extending downward from an inner end of the horizontal frame. The horizontal frame of the reinforcement frame may be located between the lower horizontal bent portion of the lower side panel and the support face of the lower top panel. The horizontal frame of the reinforcement frame and the upper horizontal bent portion of the upper side panel may be spaced apart from each other by a second distance that is smaller than the first distance. An outer end of the support face of the lower top panel may be spaced apart from the vertical bent portion of the upper side panel. The support protrusion may include a guide protrusion protruding toward the lower top panel. The lower top panel may define a guide groove at a position corresponding to a position of the guide protrusion. The guide protrusion may be inserted into the guide groove. The guide groove of the lower top panel may be positioned adjacent to the lower side panel and be recessed toward an inside of the lower treating apparatus. The guide protrusion of the support protrusion may be includes a pair of front guide protrusions disposed at opposite sides of a front portion of a bottom face of the upper base, and a pair of rear guide protrusions disposed at opposite sides of a rear portion of the bottom face of the upper base. The guide groove of the lower top panel may include a pair of front guide grooves recessed at the lower top panel and corresponding to positions of the pair of front guide protrusions, and a pair of rear guide grooves recessed at the lower top panel and corresponding to positions of the pair of rear guide protrusions. The guide protrusion may have a front guide face, a front inclined face inclined upward from a front end of the front guide face toward a bottom face of the upper base, and a rear inclined face inclined upward from a rear end of the front guide face toward the bottom face of the upper base. The guide groove may have a guide groove face, a front inclined face inclined upward from a front end of the guide groove face toward a top face of the lower top panel, and a rear inclined face inclined upward from a rear end of the guide groove face toward the top face of the lower top panel. The front inclined face of the guide groove may have an auxiliary guide face positioned to be higher than the front guide face of the guide protrusion. An outer edge of the front guide face of the guide protrusion may have a curved face. The support protrusion may be made of a same material as the upper base and integrally molded with the upper base using injection molding. The guide groove may be made of a same metal plate as the lower top panel and integrally molded with the lower top panel using press molding. The support protrusion of the upper base may extend outwardly from an outer face of the upper base. The guide protrusion of the support protrusion may extend downward from an end of the support protrusion.

One aspect of the present disclosure provides a stack-type laundry treating apparatus comprising: an upper treating apparatus including: an upper cabinet defining an upper appearance of the apparatus, and including an upper base; a drying drum rotatably disposed in the upper cabinet, wherein an object to be dried is inserted into the drying drum; an upper driver disposed on the upper base for rotating the drying drum; an air flow path for supplying and discharging air to and from the drying drum; and a heat-exchanger for dehumidifying and heating the air; and a lower treating apparatus including: a lower cabinet defining a lower appearance of the apparatus and including a lower top panel on which the upper base is mounted; a tub disposed in the lower cabinet, wherein washing-water is stored in the tub; a washing drum disposed inside the tub, wherein an object to be washed is inserted into the washing drum; and a lower driver for rotating the washing drum, wherein a support protrusion extends horizontally and outwardly from a bottom portion of the upper base to support the upper cabinet with respect to the lower cabinet.

In one implementation, the upper cabinet has an upper side panel defining a side face of the upper treating apparatus, wherein the lower cabinet has a lower side panel defining a side face of the lower treating apparatus, wherein the support protrusion is interposed between the upper side panel and the lower side panel to support the upper treating apparatus.

In one implementation, the upper side panel includes an upper horizontal bent portion horizontally extending from a bottom of the upper side panel inwardly of the upper treating apparatus, wherein the support protrusion is disposed inwardly of the upper horizontal bent portion.

In one implementation, the upper side panel has a vertical bent portion extending upward from an inner end of the horizontal bent portion, and a base support portion extending horizontally and inwardly from a top end of the vertical bent portion, wherein the base support portion is positioned above the support protrusion.

In one implementation, the lower top panel has a support face interposed between the lower side panel and the support protrusion to support the support protrusion.

In one implementation, the lower side panel has a lower horizontal bent portion horizontally extending from a top of the lower side panel and inwardly of the lower treating apparatus, wherein the support face is disposed on the lower horizontal bent portion.

In one implementation, the upper horizontal bent portion and the lower horizontal bent portion are spaced from each other by a first spacing for insulation.

In one implementation, a reinforcing frame is further disposed on the top of the lower side panel, wherein the reinforcement frame includes a horizontal frame seated on a top face of the lower horizontal bent portion, and a vertical frame extending downward from an inner end of the horizontal frame.

In one implementation, the horizontal frame is located between the lower horizontal bent portion and the support face, wherein the horizontal frame and the upper horizontal bent portion are spaced apart from each other by a second spacing smaller than the first spacing.

In one implementation, an outer end of the support face is spaced apart by a predetermined spacing from the vertical bent portion.

In one implementation, the support protrusion includes a guide protrusion protruding toward the lower top panel, wherein the lower top panel has a guide groove defined therein at a position corresponding to a position of the guide protrusion, wherein the guide protrusion is inserted into the guide groove.

In one implementation, the guide groove is adjacent to the lower side panel and is recessed inwardly of the lower treating apparatus.

In one implementation, the guide protrusion includes: a pair of front guide protrusions respectively formed on both sides of a front portion of a bottom face of the upper base; and a pair of rear guide protrusions respectively formed on both sides of a rear portion of the bottom face of the upper base, wherein the guide groove includes: a pair of front guide grooves recessed in the lower top panel in positions corresponding to positions of the pair of front guide protrusions; and a pair of rear guide grooves recessed in the lower top panel in positions corresponding to positions of the pair of rear guide protrusions.

In one implementation, the front guide protrusion has: a front guide face defining a bottom face thereof; a front inclined face inclined upward from a front end of the front guide face to a bottom face of the upper base; and a rear inclined face inclined upward from a rear end of the front guide face to the bottom face of the upper base, wherein the front guide groove has: a guide face defining a bottom face thereof; a front inclined face inclined upward from a front end of the guide face to a top face of the lower top panel; and a rear inclined face inclined upward from a rear end of the guide face to the top face of the lower top panel.

In one implementation, the front inclined face has an auxiliary guide face positioned at a level higher than a level of the front guide face.

In one implementation, an outer edge of the front guide face or the rear guide face has a curved face.

In one implementation, the upper base is manufactured via injection molding, wherein the support protrusion is integrally formed with the upper base and is made of the same material as a material of the upper base.

In one implementation, the lower top panel is manufactured by press molding a metal plate, wherein the guide groove is formed by press molding the metal plate while manufacturing the lower top panel.

In one implementation, the support protrusion extends outwardly from an outer face of the upper base, wherein the guide protrusion extends downward from one end of the support protrusion.

Implementations of the stack-type laundry treating apparatus can improve a support state in which the lower treating apparatus supports the upper treating apparatus thereon, by providing an improved fastening structure between the lower treating apparatus and the upper treating apparatus.

Further, according to implementations of the stack-type laundry treating apparatus, when the upper treating apparatus is stacked on a top of the lower treating apparatus, a stacking position of the upper treating apparatus may be corrected.

DETAILED DESCRIPTION

Hereinafter, a laundry treating apparatus according to implementations of the present disclosure will be described in detail.

For simplicity and clarity of illustration, elements in the figures are not necessarily drawn to scale. The same reference numbers in different figures denote the same or similar elements, and as such perform similar functionality. Moreover, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

First, components of a laundry treating apparatus according to an implementation of the present disclosure will be described in detail with reference to the accompanying drawings.

Figure 1:
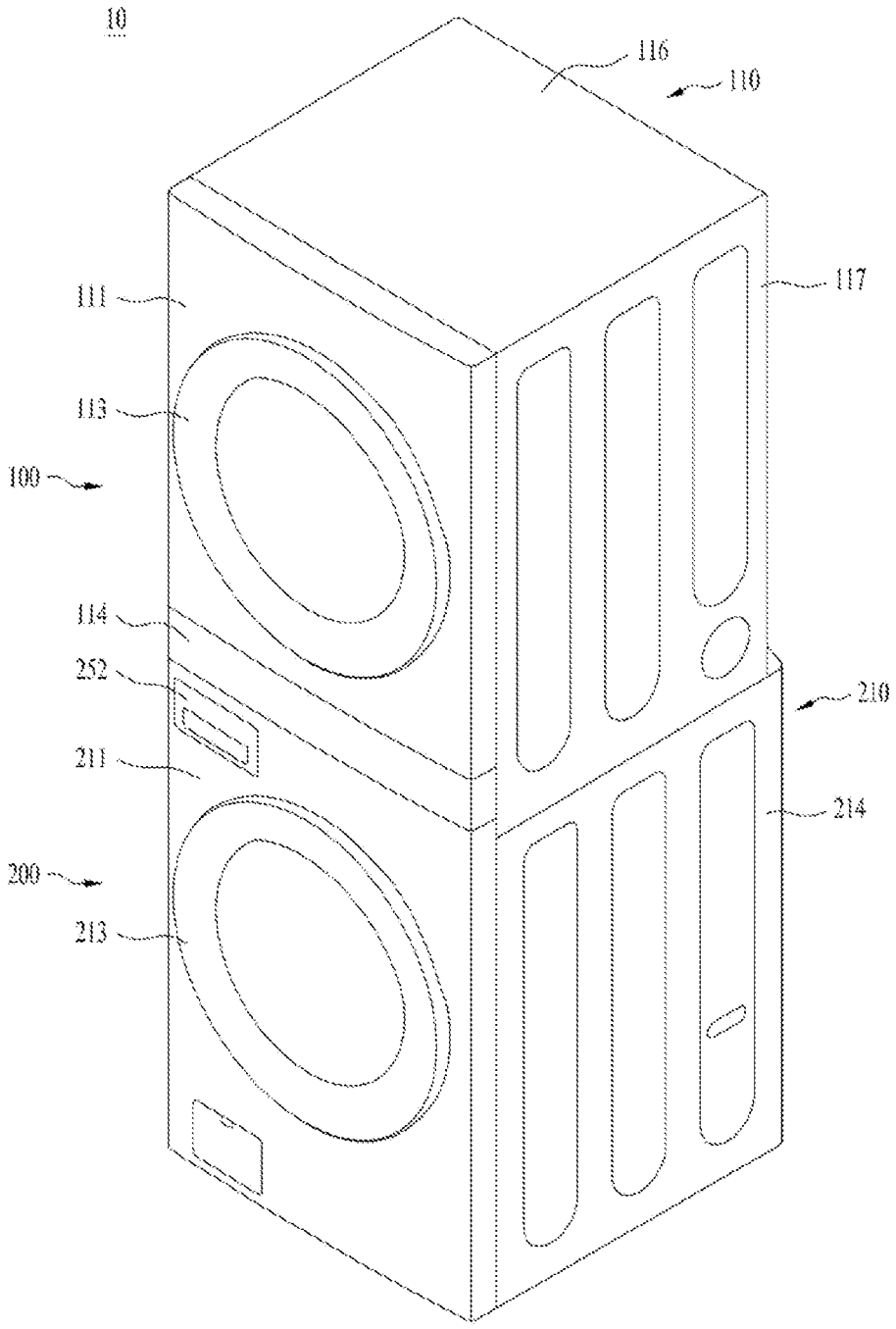
FIG. 1 is a perspective view showing a laundry treating apparatus according to implementations of the present disclosure.
Figure 2:
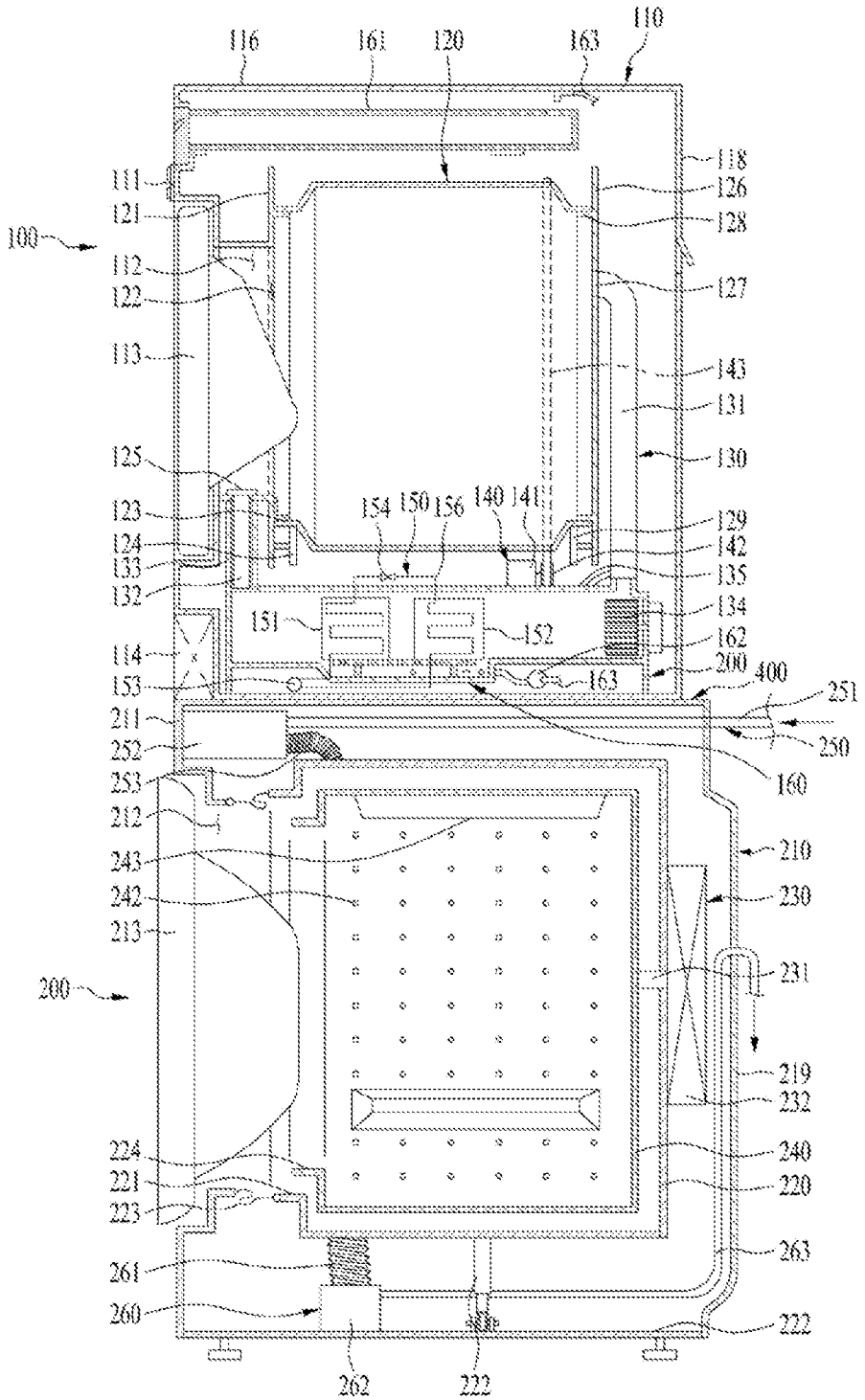
FIG. 2 is a simplified diagram showing an internal structure of the laundry treating apparatus according to implementations of the present disclosure.

FIG. 1 is a perspective view showing a laundry treating apparatus according to implementations of the present disclosure. FIG. 2 is a simplified diagram showing an internal structure of the laundry treating apparatus according to implementations of the present disclosure.

As shown in FIGS. 1 and 2, a laundry treating apparatus 10 (or a laundry treating system) according to implementations of the present disclosure includes a washing apparatus (also referred to herein as 'lower treating apparatus 200') that performs washing and rinsing of an object to be washed (laundry), and a drying apparatus (also referred to herein as 'upper treating apparatus 100') that is mounted on a top of the lower treating apparatus 200 and performs drying of an object to be dried (laundry) that has been washed or needs to be separately dried.

The drying apparatus corresponding to the upper treating apparatus 100 may use a gas burner, an electric heater, a heat pump, etc. as a heat source. Hereinafter, in implementations of the present disclosure, the upper treating apparatus 100 are primarily described as using an electric heater as the heat source.

However, the upper treating apparatus 100 is not limited to this disclosed implementations. In other implementations, the upper treating apparatus 100 may use a gas burner, a heat pump, etc. as a heat source. That is, any suitable drying apparatus should be regarded as the upper treating apparatus 100 according to implementations of the present disclosure regardless of a type of the heat source used by the drying apparatus.

The upper treating apparatus 100 includes an upper cabinet 110, a drying drum 120, an air circulating channel 130, a driver 140, a heat-exchanger 150, and a water discharger 180. The upper cabinet 110 defines an upper appearance thereof and including an upper front panel 111, an upper top panel 116, an upper side panel 117, an upper rear panel 118 and an upper base 300. The drying drum 120 is rotatably disposed inside the upper cabinet 110 and receiving and drying an object to be dried using heated air supplied thereto. The air circulating channel 130 is configured for supplying the heated air to the drying drum 120 and for discharging air used for drying the object to be dried out of the drying drum 120. The driver 140 can rotate the drying drum 120 at a predefined rotational speed. The heat-exchanger 150 can heat and supply air of the air circulating channel 130. The water discharger 180 can discharge condensate generated from the heat-exchanger 150.

An upper inlet 112 may be defined in the upper front panel 111. The object to be dried can be inserted into the drying drum 120 through the upper inlet 112. An upper door 113 to open and close the upper inlet 112 may be disposed at the upper front panel 111. A control panel 114 for controlling the upper treating apparatus 100 and the lower treating apparatus 200 may be disposed at a lower level of the upper front panel 111.

In some implementations, the control panel 114 may include a manipulator for simultaneous or selective control of the upper treating apparatus 100 and the lower treating apparatus 200, and a display for simultaneous or selective display of operating statuses of the upper treating apparatus 100 and the lower treating apparatus 200.

The upper side panel 117 and the upper rear panel 118 may have separate plate forms or may be formed in an integral manner to each other by bending one panel. The upper side panel 117 and the upper rear panel 118 may be integrally formed to improve a strength of the upper treating apparatus 100.

In some implementations, a horizontal bent portion 117*a* that is bent inwardly of the upper treating apparatus 100 extends from a bottom of the upper side panel 117. A vertical bent portion 117*b* that is bent upwardly of the upper treating apparatus 100 extends from an end of the horizontal bent portion 117*a*. A base support portion 117*c* extends from an end of the vertical bent portion 117*b*, and is bent inwardly of the upper treating apparatus 100 and is supported on a support protrusion 380.

The upper rear panel 118 may have a service panel which defines a rear portion of the upper treating apparatus 100, and opens and closes the upper rear panel 118 for maintenance of the upper treating apparatus 100. Further, an air discharge duct 135 (a connection duct) of the air circulating channel 130 to be described later may pass through the upper rear panel 118.

Each of the components (e.g., the drying drum 120, the air circulating channel 130, the driver 140, the heat-exchanger 150, etc.) of the upper treating apparatus 100 is supported and installed on a bottom of the upper cabinet 110. The upper base 300 has a support protrusion 380, a front guide protrusion 381, and a rear guide protrusion 386 for setting an installation position of the upper washing apparatus 100 with respect to the lower treating apparatus 200. The upper base 300 will be described in detail.

The drying drum 120 may be formed in a cylindrical shape having open front and rear faces. A front plate 121 and a front plate 126 can rotatably support the drying drum 120 and may be disposed in front and rear of the drying drum 120, respectively.

The front plate 121 has an opening 122 defined therein that communicates with the upper inlet 112 defined in the upper front panel 111. The front plate 121 has a front support 123 disposed around an outer circumferential face of the opening 122 and in front of the drying drum 120 and supporting a front inner circumferential face of the drying drum 120.

A front roller 124 is disposed below the front support 123 to rotatably support a front lower portion of the drying drum 120. A plurality of air intake holes 125 are formed in a lower portion of the front plate 121. Air from the drying drum 120 can be suctioned into the air circulating channel 130 through the plurality of air intake holes 125. An air intake duct 133 of the air circulating channel 130 is connected to the air intake holes 125.

The front plate 126 has a plurality of air supply holes 127 defined therein to which the air supply duct 131 of the air circulating channel 130 (described in more detail later) is connected and through which air is supplied into the drying drum 120. A rear support 128 that supports a rear inner circumferential face of the drying drum 120 is disposed outside the air supply hole 127 and in rear of the drying drum 120. A rear roller 129 that rotatably supports a bottom of the drying drum 120 is disposed below the rear support 128.

The air circulating channel 130 includes the air intake duct 133 communicating with the air intake holes 125 to take air in the drying drum 120. The air circulating channel 130 can further include an air supply duct 131 that supplies air from the air intake duct 133 to the drying drum 120, a connection duct 135 which connects the air intake duct 133 and the air supply duct 131 to each other and receives therein a heat-absorber 151 and a heat-emitter 152 of the heat-exchanger 150, and a fan 134 disposed between the air supply duct 131 and the air intake duct 133 to allow the air inside the drying drum 120 to circulate along the air intake duct 133, the connection duct 135 and the air supply duct 131.

In one example, a filter 132 may be detachably disposed in the air intake hole 125 of the air intake duct 133 and can filter foreign substances such as lint contained in the air suctioned from the drying drum 120. The connection duct 135 may be coupled to the upper base 300 (described later in more detail) to define a flow path space in which the heat-absorber 151 and the heat-emitter 152 are installed. Further, the air supply duct 131 guides air respectively dehumidified and heated at the heat-absorber 151 and the heat-emitter 152 disposed in the connection duct 135 to the inside of the drying drum 120.

In some implementations, the air inside the drying drum 120 is suctioned through the air intake duct 133 into the channel 130 under an operation of the fan 134, thereby reducing a pressure of the drying drum 120. As the pressure of the drying drum 120 decreases, air from the outside of the drying drum 120 is supplied to the inside of the drying drum 120 through the air supply duct 131. In some implementations, the air moving through the air supply duct 131 is heated by the heat-exchanger 150 disposed in the connection duct 135 and then supplied to the inside of the drying drum 120.

In some implementations, the fan 134 may be placed in either the air intake duct 133, the connection duct 135 or the air supply duct 131. In the present disclosure, the fan 134 is primarily described as being disposed between the connection duct 135 and the air supply duct 131, that is, located behind the heat-emitter 152.

The heat-exchanger 150 may be embodied as various devices which may sequentially perform dehumidification and heating of the air introduced into the connection duct 135. In the present disclosure, the heat-exchanger 150 is described primarily as being embodied as a heat pump by way of example.

The heat-exchanger 150 includes a heat-absorber 151 placed inside the connection duct 135 to remove moisture from the air flowing into the connection duct 135, a heat-emitter 152 placed inside the connection duct 135 to heat the air that has passed through the heat-absorber 151, a compressor 153 that compresses refrigerant that has passed through the heat-emitter 152 and supplies the compressed refrigerant to the heat-absorber 151, and a pressure regulator 154 that controls a pressure of the refrigerant that has passed through the heat-emitter 152. The components of the heat-exchanger 150 may be connected to each other via a refrigerant pipe 156 along which the refrigerant flows.

In some implementations, each of the heat-absorber 151 and the heat-emitter 152 may be embodied as a plurality of metal plates extending in parallel with a flow direction of air along a width direction of the connection duct 135 or a height direction of the connection duct 135. The heat-absorber 151 and heat-emitter 152 are sequentially arranged in a direction from the air intake duct 133 to the air supply duct 131 and inside the connection duct 135.

The driver 140 is configured to rotate the drying drum 120 at a predefined rotational speed. The driver 140 may have a motor 141 that generates power, a pulley 142 disposed on a rotation shaft of the motor 141, and a belt 145 connecting the pulley 142 and an outer circumferential face of the drying drum 120.

In some implementations, the pulley 142 may be disposed on one end of the rotation shaft of the motor 141, and the fan 134 of the air circulating channel 130 may be disposed at the other end of the rotation shaft. That is, one motor 141 may be used to simultaneously operate the fan 134 of the air circulating channel 130 and the drying drum 120. In this case, the drying drum 120 and the fan 134 may be driven by the single motor 141, so that the drying drum 120 and the fan 134 may rotate at a constant rotation speed ratio and at a constant rotation speed.

In another example, separate motors may be disposed on the drying drum 120 and the fan 134, respectively. When the separate motors are disposed on the drying drum 120 and fan 134, respectively, the rotation speeds of the drying drum 120 and the fan 134 may be individually controlled.

In one example, the water discharger 180 is configured to drain condensate generated from the heat-absorber of the heat-exchanger. The water discharger 180 may include a water storage body 161 that is detachably disposed in the upper cabinet 110 to provide a space for storing water therein, a water discharge pump 162 placed on the upper base 300 to pump the condensate generated from the heat-absorber 151, and a water discharge pipe 163 that guides the condensate pumped from the water discharge pump 162 to the water storage body 161.

In some implementations, the water storage body 161 may be embodied as a drawer-type tank which is withdrawn from the upper cabinet 110. A front face of the water storage body 161 may define a portion of the upper front panel 111.

In the above-described upper treating apparatus 100, as the object to be dried is provided into the drying drum 120 through the upper inlet 112, the drying drum 120 is rotated by the driver 140, and thus the object to be dried inside the drying drum 120 moves.

Further, as the fan 134 is rotated by the driver 140, the air inside the drying drum 120 is circulated along the air intake duct 133 and the air supply duct 131, and is heated by the heat-exchanger placed in the connection duct and then supplied to the drying drum 120.

The lower treating apparatus 200 includes a lower cabinet 210 defining a lower appearance thereof, and including a lower front panel 211, a lower side panel 214, a lower rear panel 219, a lower top panel 400, and a lower base panel 219*a*, a tub 220 disposed inside the lower cabinet 210 to store washing-water therein, a washing drum 240 that is rotatably disposed inside the tub 220 to wash the input washing target, a driver 230 which is disposed in rear of the tub 220 to rotate the washing drum 240, a water supply 250 that supplies washing-water to the tub 220, a detergent supply 252 that mixes detergent and the washing-water supplied from the water supply with each other to supply the mixture to the washing drum, and a water discharger 260 that drains the washing-water inside the tub 220.

The lower front panel 211 has a lower inlet 212 defined therein through which the object to be washed is input into the washing drum 240. A lower door 213 for opening and closing the lower inlet 212 is disposed on the lower front panel 211.

A lower horizontal bent portion 214*a* is bent inwardly of the lower treating apparatus 200 from a top of the lower side panel 214. The support protrusion 380 of the upper base 300 and the base support portion 117*c* of the upper side panel 117 are sequentially seated on the lower horizontal bent portion 214*a*.

Further, a reinforcing frame 215 which may increase a strength of a top of the lower side panel 214 is seated on the lower horizontal bent portion 214*a*. The support protrusion 380 of the upper base 300 is seated on the reinforcing frame 215.

In some implementations, the reinforcing frame 215 may have a horizontal frame 216 seated on a top face of the lower side panel 214 and a vertical frame 217 extending vertically and downwards from an inner end of the horizontal frame 216.

The lower side panel 214 and the lower rear panel 219 may be provided in separate plate forms, or may be formed integrally to each other by bending one panel. The lower side panel 214 and the lower rear panel 219 may be integrally formed to improve strength of the lower treating apparatus 200.

The lower front panel 211 and the lower side panel 214 as above-described and the upper front panel 111 and the upper side panel 117 may constitute the same vertically extending layers, respectively. That is, the lower front panel 211, the upper front panel 111 and the control panel 114 located at a lower portion of the upper front panel 111 may constitute the same vertically extending layer.

Further, the upper side panel 117 and the lower side panel 214 may define left and right sides of the upper treating apparatus 100 and the lower treating apparatus 200, respectively, and may constitute the same vertically extending layers.

In one example, the lower top panel 400 is located on a top of the lower front panel 211 and the lower side panel 214 and serves to separate the lower treating apparatus 200 and the upper treating apparatus 100 from each other, and at the same time, to support and align the upper treating apparatus 100 with respect to the lower treating apparatus 200.

Further, when a fire accident occurs in the lower treating apparatus 200 or the upper treating apparatus 100, the lower top panel 400 may serve as a flameproof panel to prevent the fire from one of the lower treating apparatus 200 and the upper treating apparatus 100 from being transferred to the other thereof.

Further, the lower top panel 400 may have a front guide groove 410 and a rear guide groove 420 defined therein respectively at positions corresponding to positions of the front guide protrusion 381 and the rear guide protrusion 386 formed on the upper base 300 to set the installation position of the upper treating apparatus 100. The lower top panel 400 will be described herein in detail.

The lower rear panel 219 may have a service panel which defines a rear portion of the lower treating apparatus 200, and which opens and closes the lower rear panel 219 for maintenance of the lower treating apparatus 200. Further, a water supply pipe 251 of the water supply 250 and a water discharge pipe 263 of the water discharger 260 (described later in more detail) may pass through the lower rear panel 219.

In one example, the upper treating apparatus 100 is disposed on the top of the lower treating apparatus 200 according to implementations of the present disclosure. The top face of the lower treating apparatus 200 is covered with the upper treating apparatus 100.

The tub 220 is disposed inside the lower cabinet 210 and is formed in a cylindrical shape and moves via a suspension 222 such as a spring and a damper. A tub opening 221 is formed in a front face of the tub 220 and communicates with the lower inlet 212 formed in the lower front panel 211. The lower inlet 212 of the lower front panel 211 and the tub opening 221 may further have a bellows type gasket 223 to provide watertight sealing when the tub 220 moves.

The driver 230 is disposed on a rear face of the tub 220 to rotate the washing drum 240, and has an outer rotor type motor 232 disposed on the rear face of the tub 220 and a rotation shaft 231 that passes through the rear face of the tub 220 and transmits the rotational force of the motor 232.

The washing drum 240 is disposed in the tub 220 and is formed in a cylindrical shape and is connected to the rotation shaft 231 so that the drum 240 rotates. The washing drum 240 has a drum opening 241 defined in a front face thereof communicating with the tub opening 221 formed in the tub 220. The object to be washed is injected through the drum opening 241 to the drum 240. Further, a plurality of water communication holes 242 for flowing the washing-water may be defined in an inner circumferential face of the washing drum 240. A plurality of lifters 243 for moving the object to be washed may be disposed in the washing drum 240.

The water supply 250 receives washing-water from an external water supply source to the laundry treating apparatus 10. The water supply 250 includes a water supply pipe 251 to which the external water supply source is connected, and a detergent supply 252 connected to the water supply pipe 251 and mixing the water and detergent and supplying the mixture to the tub 220, and a water supply hose 253 connecting the detergent supply 252 and the tub 220 to each other.

The water discharger 260 is disposed under the tub 220 to drain the washing-water that has been used in the tub 220. The water discharger 260 includes a water discharge hose 261 connected to a bottom face of the tub 220, the water discharge pump 262 disposed at the water discharge hose 261 to pump the washing-water, and a water discharge pipe 263 to discharge the washing-water pumped by the water discharge pump 262 to the outside.

In the lower treating apparatus 200 as described above, as the object to be washed is introduced into the washing drum 240 through the lower inlet 212, the detergent and washing-water are supplied to the tub 220 from the water supply 250. As the washing drum 240 rotates by the driver 230, the object to be washed moves inside the washing drum 240 and the washing process proceeds.

Further, as the washing process is completed, the washing-water inside the tub 220 is discharged to the outside of the lower treating apparatus 200 by the water discharge pump 262 of the water discharger 260, thereby completing the washing process.

In one example, the lower treating apparatus 200 is installed on an installation place, and then the upper treating apparatus 100 is seated on the top of the lower treating apparatus 200, thereby completing the installation of the laundry treating apparatus 10.

Hereinafter, the upper base 300 of the upper treating apparatus 100 according to an implementation of the present disclosure will be described in detail with reference to the accompanying drawings.

Figure 3:
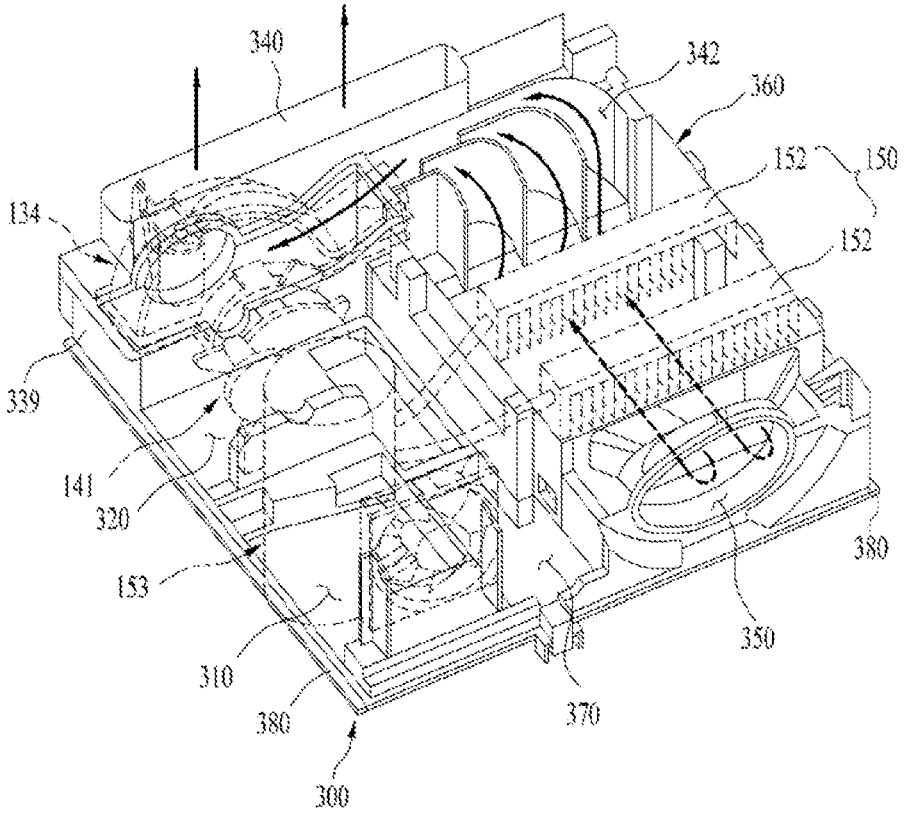
FIG. 3 is a perspective view showing an upper base of an upper treating apparatus according to an implementation of the present disclosure.
Figure 4:
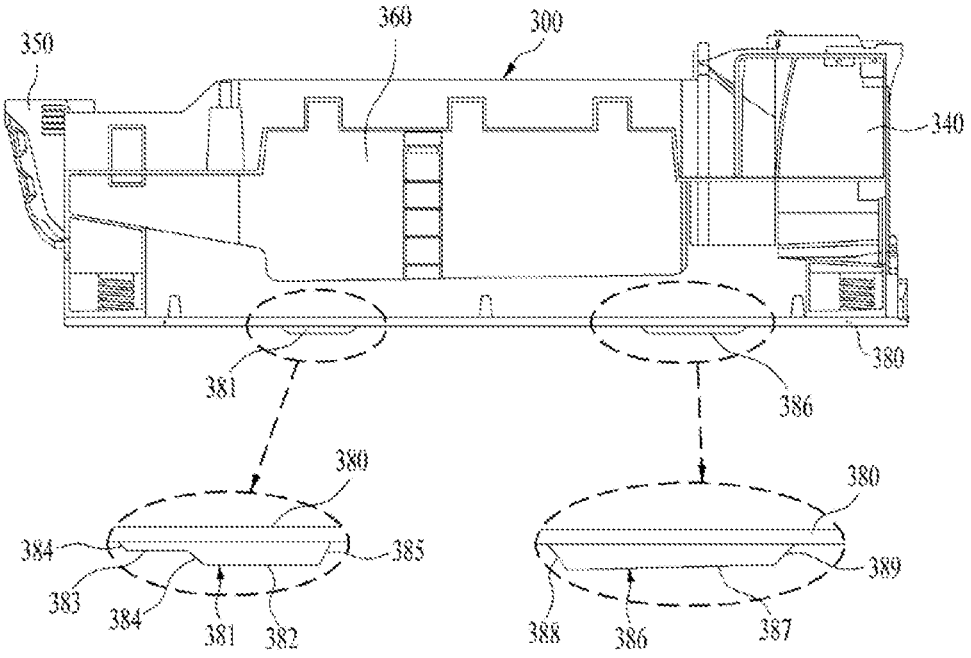
FIG. 4 is a side view showing an upper base of an upper treating apparatus according to an implementation of the present disclosure.

FIG. 3 is a perspective view showing the upper base of the upper treating apparatus according to an implementation of the present disclosure. FIG. 4 is a side view showing the upper base of the upper treating apparatus according to an implementation of the present disclosure.

As shown, the upper base 300 according to an implementation of the present disclosure includes (i) a compressor receiving portion 310 on which the compressor 153 of the heat-exchanger 150 is installed, (ii) a fan receiving portion 330 on which the fan 134 of the heat-exchanger 150 is mounted, (iii) an air supply duct connector 340 to which the air supply duct 131 is connected, (iv) an air intake duct connector 350 to which the air intake duct 133 is connected, (v) a water collector 360 connected to the connection duct 135 and the air intake duct connector 350 and thus connected to the heat-absorber 151 and the heat-emitter 152 of the heat-exchanger 150, wherein the condensate generated from the heat-absorber 151 is stored in the collector 360, and (vi) a water discharge pump receiving portion 370 on which a water discharge pump 162 to drain the water collected from the water collector 360 is installed.

The compressor receiving portion 310, the motor receiving portion 320, the fan receiving portion 330, the water collector 360, the water discharge pump receiving portion 370, etc. of the upper base 300 may be arranged differently according to different connections of the components and different configurations of flow paths therebetween.

In one example, the water collector 360 is formed in a shape of a casing whose front and rear ends are opened. Thus, the water collector 360 is connected to and communicates with the connection duct 135. The heat-absorber 151 and the heat-emitter 152 may be located at a position at which the water collector 360 and the connection duct 135 are connected to each other.

In some implementations, the air intake duct connector 350 to which the air intake duct 133 is connected may be located at the front end of the water collector 360. The air supply duct connector 340 may be located at the rear end of the water collector 360. Further, between the water collector 360 and the air supply duct 131, a switch channel 342 may be further formed to switch a direction of the air passing through the heat-absorber 151 and the heat-emitter 152 of the water collector toward the air supply duct 131.

In one example, a support protrusion 380 may protrude from a lower portion of an outer face of the upper base 300 and is configured to maintain a spacing between the upper treating apparatus 100 and the lower treating apparatus 200. The support protrusion 380 is interposed between the upper treating apparatus 100 and the lower treating apparatus 200 to allow an electrical insulation state between the upper treating apparatus 100 and the lower treating apparatus 200.

In one example, a pair of front guide protrusions 381 and a pair of rear guide protrusions 386 may be formed on both sides of a bottom face of the upper base 300. The pair of front guide protrusions 381 and the pair of rear guide protrusions 386 may be seated on the lower top panel 400 when the upper treating apparatus 100 is seated on the top face of the lower treating apparatus 200.

In some implementations, the pair of front guide protrusions 381 and the pair of rear guide protrusions 386 may protrude downward from the bottom face of the support protrusion 380 toward the lower treating apparatus 200.

Alternatively, the pair of front guide protrusions 381 and the pair of rear guide protrusions 386 may not directly protrude from the support protrusion 380. The support protrusion 380 may extend from an outer face of the upper base 300 and may be disposed above the pair of front guide protrusion 381 and the pair of rear guide protrusion 386.

In one example, the front guide protrusions 381 may be arranged in a symmetrical manner in the left and right direction of the upper base 300 and may be formed on a front portion of a bottom face of the support protrusion 380. Each front guide protrusion 381 has a front guide face 382 as a bottom face, and an auxiliary guide face 383 that is located at a higher level than a level of the front guide face 382.

In some implementations, a first rear inclined face 385 that is inclined upwards toward a rear portion of the upper base 300 may be formed on a rear end of the front guide face 382. A first front inclined face 384 is formed between the front guide face 382 and the auxiliary guide face 383. A further first front inclined face 384 is formed at a front end of the auxiliary guide face 383. The first front inclined face 384 is inclined upwards toward a front portion of the upper base 300.

In some implementations, the front guide face 382 and the auxiliary guide face 383 are temporarily seated on one face of the front guide groove 410 formed in the lower top panel 400 of the lower treating apparatus 200 when the upper treating apparatus 100 is seated on the lower treating apparatus 200.

In particular, the auxiliary guide face 383 may be temporarily supported on the lower top panel 400 while the front guide face 382 is partially inserted into the front guide groove 410 before the front guide protrusion 381 is completely inserted into the front guide groove 410.

In one example, when the upper treating apparatus 100 is seated on the lower treating apparatus at a correct position thereof, the front guide face 382 and the auxiliary guide face 383 may be located inside the front guide groove 410 formed in the lower top panel 400, and each front guide protrusion 381 may be inserted into each front guide groove 410.

In one example, when the upper treating apparatus 100 is seated on the lower treating apparatus 200, and when each front guide protrusion 381 is spaced from each front guide groove 410 in a rear and front direction, the first front inclined face 384 and the first rear inclined face 385 may allow each front guide protrusion 381 to slide and move into each front guide groove 410.

Figure 8:
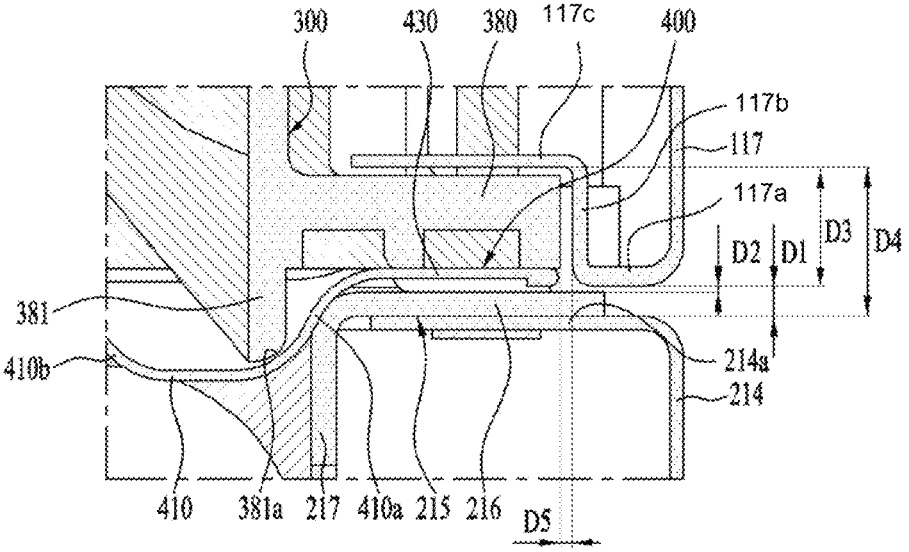
FIG. 8 is a partial cross-sectional view showing an upper base and a lower top panel according to an implementation of the present disclosure.

Further, an outer edge of the front guide face 382 of each front guide protrusion 381, that is, a front outer edge of the upper base 300 may be formed as a curved face 381*a* that is curved inwardly of the upper base 300 or an inclined face which is inclined inwardly of the upper base 300 (refer to FIG. 8).

In some implementations, when the upper treating apparatus 100 is misaligned with the lower treating apparatus 200 in the left-right direction, the curved face 381*a* formed on the front guide face 382 may slide along the inner face of the front guide groove 410.

In one example, the rear guide protrusions 386 may be arranged in a symmetrical manner in the left and right direction of the upper base 300 and may be disposed on a rear portion of the bottom face of the support protrusion 380. Each rear guide protrusion 386 has a rear guide face 387 as a bottom face thereof.

In some implementations, a second rear inclined face 389 that is inclined upwards toward a rear portion of the upper base 300 may be formed on a rear end of the rear guide face 387. A second front inclined face 388 that is inclined upwards toward the front portion of the upper base 300 may be formed on a front end of the rear guide face 387.

In one example, when the upper treating apparatus 100 is seated on the lower treating apparatus at the correct position thereof, the rear guide face 387 may be located inside the rear guide groove 420 formed in the lower top panel 400, and each rear guide protrusion 386 may be inserted into each rear guide groove 420.

In some implementations, when the upper treating apparatus 100 is seated on the lower treating apparatus 200 and when each rear guide protrusion 386 is spaced from each rear guide groove 420 in the front and rear direction, the second front inclined face 388 and the second rear inclined face 389 may allow each rear guide protrusion 386 to slide and move into each rear guide groove 420.

Further, an outer edge of the rear guide face 387 of each rear guide protrusion 386, that is, a rear outer edge of the upper base 300 may be a curved face 386*a* that is curved inwardly of the upper base 300 or an inclined face which is inclined inwardly of the upper base 300 (See FIG. 8).

In some implementations, when the upper treating apparatus 100 is misaligned with the lower treating apparatus 200 in the left and right direction, the curved face 386*a* formed on the rear guide face 387 may slide along the inner face of the rear guide groove 420.

In one example, the heat-exchanger 150 including the heat-absorber 151, the heat-emitter 152, and the compressor 153 installed on the upper base 300 is configured to operate at a relatively low temperature. Accordingly, the upper base 300 may not have a flame retardant or heat dissipation function.

Therefore, the upper base 300 may be manufactured integrally via injection molding which is a relatively easy manufacturing scheme. The upper base 300 may be integrally injection-molded and may be made of a synthetic resin material, for example, ABS material, PC material, plastic, etc.

That is, the compressor receiving portion 310, the motor receiving portion 320, the fan receiving portion 330, the water collector 360, the water discharge pump receiving portion 370 formed on the top face of the upper base 300 may be integrally formed with each other via injection molding.

Further, the support protrusion 380, the pair of front guide protrusions 381, and the pair of rear guide protrusions 386 as above-described may be made of the same material as that of the upper base 300 and may be integrally injection-molded on a side face and a top face of the upper base 300 when manufacturing the upper base 300.

Hereinafter, the lower top panel 400 of the lower treating apparatus 200 according to an implementation of the present disclosure will be described in detail with reference to the accompanying drawings.

Figure 5:
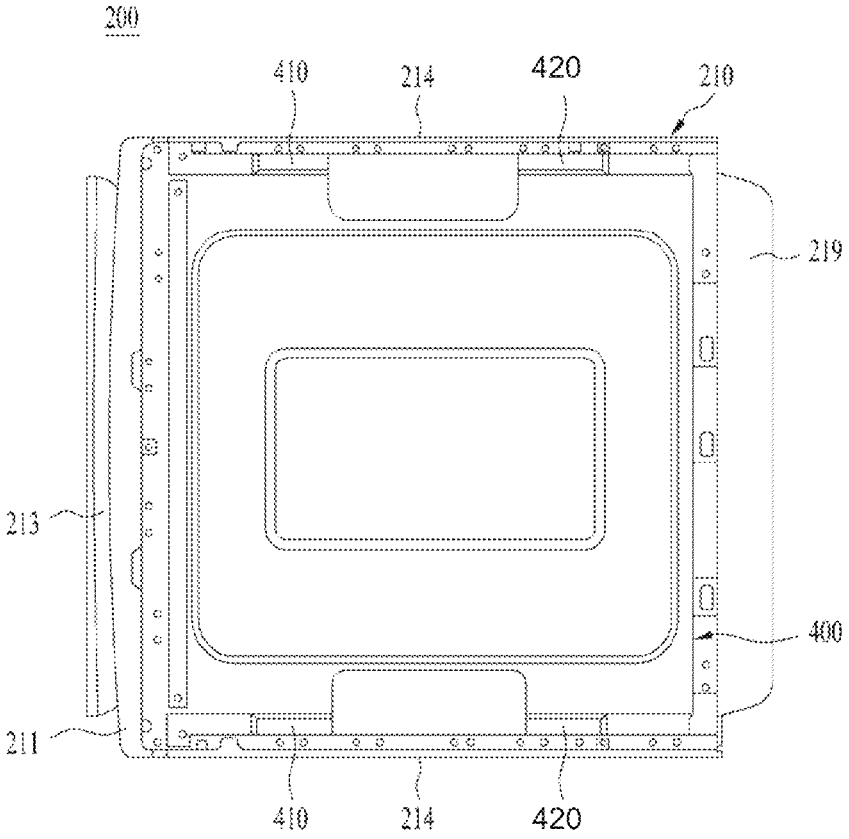
FIG. 5 is a plan view showing a lower top panel of a lower treating apparatus according to an implementation of the present disclosure.
Figure 6:
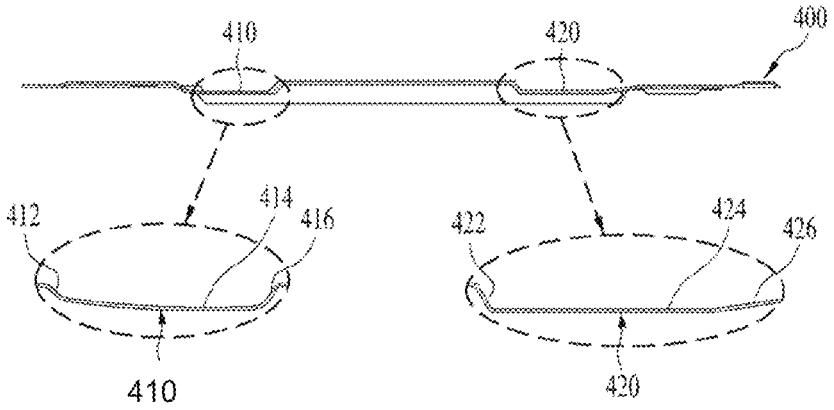
FIG. 6 is a side cross-sectional view showing a lower top panel of a lower treating apparatus according to an implementation of the present disclosure.

FIG. 5 is a plan view showing the lower top panel of the lower treating apparatus according to an implementation of the present disclosure. FIG. 6 is a side cross-sectional view showing the lower top panel of the lower treating apparatus according to an implementation of the present disclosure.

In one example, the lower top panel 400 of the lower treating apparatus 200 has a pair of front guide grooves 410 defined in both sides of a front portion thereof at positions corresponding to the positions of the front guide protrusions 381 formed on the upper base 300. The lower top panel 400 of the lower treating apparatus 200 has a pair of rear guide grooves 420 defined in both sides of a rear portion thereof at positions corresponding to the positions of the rear guide protrusions 386 formed on the upper base 300.

Further, a support face 430 interposed between the upper side panel 117 and the lower side panel 214 may be formed on an outer edge portion of the lower top panel 400. In some implementations, the support face 430 may support the support protrusion 380 of the upper base 300 and may be interposed between the upper side panel 117 and the lower side panel 214 as the support protrusion 380 may.

In some implementations, the front guide groove 410 has a first guide face 414 so that the front guide protrusion 381 formed on the upper base 300 is seated thereon. In front of the first guide face 414, a first front inclined face 412 that is inclined downwards from a top face of the lower top panel 400 to the first guide face 414 is formed. In rear of the first guide face 414, a first rear inclined face 416 that is inclined downwards from the top face of the lower top panel 400 to the first guide face 414 is formed.

In some implementations, the first front inclined face 412 and the first rear inclined face 416 may allow the front guide protrusion 381 of the upper base 300 to slide such that the front guide protrusion 381 is inserted into the front guide groove 410.

In one example, the rear guide groove 420 has a second guide face 424 so that the rear guide protrusion 386 formed on the upper base 300 is seated thereon. In front of the second guide face 424, a second front inclined face 422 that is inclined downward from the top face of the lower top panel 400 to the second guide face 424 is formed. In rear of the second guide face 424, a second rear inclined face 426 that is inclined downward from the top face of the lower top panel 400 to the second guide face 424 is formed.

In some implementations, the second front inclined face 422 and the second rear inclined face 426 may allow the front guide protrusion 381 of the upper base 300 to slide so that the front guide protrusion 381 is inserted into the front guide groove 410.

Hereinafter, a process in which the upper treating apparatus 100 according to an implementation of the present disclosure is seated on the lower treating apparatus 200 will be described in detail with reference to the accompanying drawings.

Figure 7A:
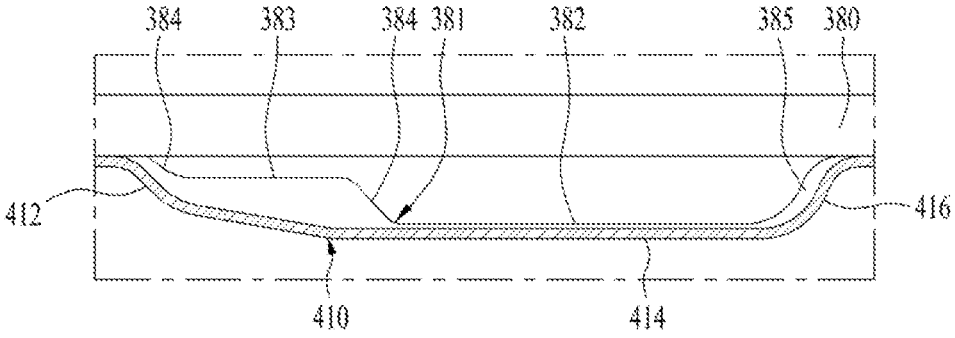
FIGS. 7A and 7B are partial cross-sectional views showing a stack state of an upper treating apparatus and a lower treating apparatus according to an implementation of the present disclosure.
Figure 7B:
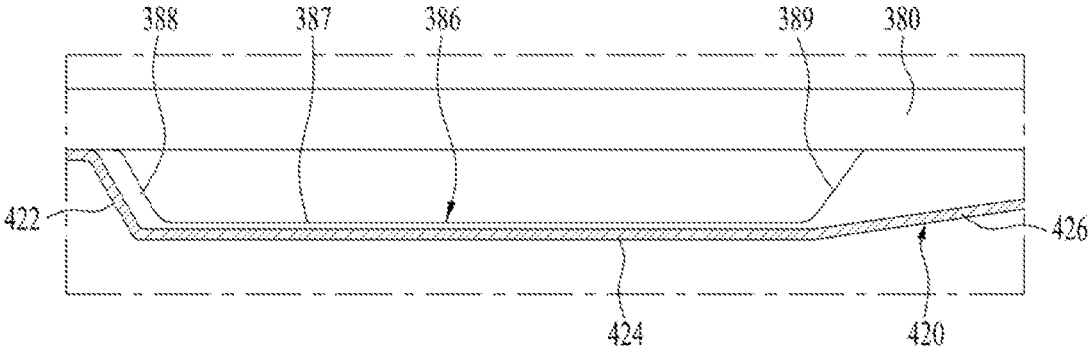

FIGS. 7A and 7B are partial cross-sectional views showing a stacked state of an upper treating apparatus and a lower treating apparatus according to an implementation of the present disclosure. FIG. 8 is a partial cross-sectional view showing the upper base and the lower top panel according to an implementation of the present disclosure.

As shown, according to the present disclosure, when the upper treating apparatus 100 is stacked on the lower treating apparatus 200, the support protrusion 380 formed on the upper base 300 is interposed between the lower side panel 214 of the lower treating apparatus 200 and the upper side panel 117 of the upper treating apparatus 100 to support the upper side panel 117 with respect to the lower side panel 214.

In some implementations, the front guide protrusion 381 of the upper base 300 is inserted into the front guide groove 410 of the lower top panel 400. The rear guide protrusion 386 of the upper base 300 is inserted into the rear guide groove 420 of the lower top panel 400.

In some implementations, as shown in FIG. 7A, the first front inclined face 384 or the first rear inclined face 385 of the front guide protrusion 381 may slide on and along the first front inclined face 412 or the first rear inclined face 416 of the front guide groove 410 so that the front guide protrusion 381 may be inserted into the front guide groove 410.

Further, as shown in FIG. 7B, the second front inclined face 388 or the second rear inclined face 389 of the rear guide protrusion 386 may slide on and along the second front inclined face 422 or the second rear inclined face 426 of the rear guide groove 420 so that the rear guide protrusion 386 may be inserted into the rear guide groove 420.

In one example, the lower top panel 400 as described above may be manufactured by press-molding a metal plate of a predetermined thickness. Further, the front guide groove 410 and the rear guide groove 420 formed in the lower top panel 400 may be formed via press-molding when manufacturing the lower top panel 400.

In some implementations, as long as the lower top panel 400 performs strength-increasing and fire-retardant functions while supporting the upper treating apparatus 100, the lower top panel 400 may be made of other materials than the metal plate, and may be manufactured by methods other than the press-molding of the metal plate.

For example, the lower top panel 400 may be manufactured by injection molding of a synthetic resin material having a flame retardant function. During the injection molding, the front guide groove 410 and the rear guide groove 420 may be integrally formed with the lower top panel 400.

In one example, as shown in FIG. 8, predefined spacing for insulation between the upper treating apparatus 100 and the lower treating apparatus 200 may be formed between the support protrusion 380 of the upper base 300, the lower top panel 400, the upper side panel 117, and the lower side panel 214.

First, the upper horizontal bent portion 117*a* of the upper side panel 117 and the lower horizontal bent portion 214*a* of the lower side panel 214 may be spaced apart from each other by a first spacing D1. Further, when the reinforcing frame 215 is disposed on the lower side panel 214, the horizontal frame 216 of the reinforcing frame 215 and the upper horizontal bent portion 117*a* of the upper side panel 117 may be spaced from each other by a second spacing D2 smaller than the first spacing D1.

In some implementations, the first spacing D1 and the second spacing D2 may be a spacing between the upper side panel 117 and the lower side panel 214 and thus act as the insulating spacing between the upper treating apparatus 100 and the lower treating apparatus 200.

In one example, the base support portion 117*c* of the upper side panel 117 may have a third spacing D3 from the upper horizontal bent portion 117*a* of the upper side panel 117. The third spacing D3 may be smaller than a sum of a thickness of the support protrusion 380 of the upper base 300 and a thickness of the support face 430 of the lower top panel 400.

Therefore, the horizontal bent portion 117*a* of the upper side panel 117 may be spaced apart from and thus may be insulated from the lower horizontal bent portion 214*a* of the lower side panel 214 when the base support portion 117*c* is supported on the support protrusion 380.

In some implementations, when the reinforcing frame 215 is further disposed on the lower side panel 214, the base support portion 117*c* of the upper side panel 117 may have a fourth spacing D4 from the lower horizontal bent portion 214*a* of the lower side panel 214.

In one example, the fourth spacing D4 may be equal to a sum of a thickness of the support protrusion 380 of the upper base 300, a thickness of the support face 430 of the lower top panel 400, and a thickness of the horizontal frame 216 of the reinforcing frame 215. The horizontal bent portion 117*a* of the side panel 117 may have the first spacing D1 from the lower horizontal bent portion 214*a*.

In some implementations, the first spacing D1 may be the spacing between the lower horizontal bent portion 214*a* of the lower side panel 214 and the upper horizontal bent portion 117*a* of the upper side panel 117 as described above. As shown, the first spacing D1 may be larger than a thickness of the horizontal frame 216 of the reinforcing frame 215.

In one example, the support face 430 interposed between the upper side panel 117 and the lower side panel 214 may be spaced apart from the vertical bent portion 117*b* of the upper side panel 117 by a fifth spacing D5. The fifth spacing D5 between the support face 430 and the vertical bent portion 117*b* may act as an insulating space between the lower treating apparatus 200 and the upper side panel 117.

As described above, the support protrusion 380 may be spaced from the vertical bent portion 117*b* inward of the horizontal bent portion 117*a* of the upper side panel 117 by a predetermined spacing. The base support portion 117*c* may be placed on a top of the support protrusion 380.

As a result, the support protrusion 380 may be spaced apart from the vertical bent portion 117*b* of the upper side panel 117 by a predetermined spacing and may be positioned inwardly of the upper side panel or inwardly of the horizontal bent portion 117*a*. Further, the support protrusion 380 may be disposed under the base support portion 117*c* while being spaced apart by a predetermined spacing from the vertical bent portion 117*b*.

Therefore, in the stack-type laundry treating apparatus 10 according to implementations of the present disclosure as described above, when the upper treating apparatus 100 is stacked on a top of the lower treating apparatus 200, the front guide protrusion 381 and the rear guide protrusion 386 formed on the upper base 300 of the upper treating apparatus 100 are respectively inserted into the front guide groove 410 and the rear guide groove 420 formed in the lower top panel 400 of the lower treating apparatus 200. Thus, the upper treating apparatus 100 may be stacked on and in an aligned state with respect to the lower treating apparatus 200.

Further, in the stack-type laundry treating apparatus 10 according to implementations of the present disclosure as described above, the plurality of spaces for insulation are formed between the upper side panel of the upper treating apparatus and the lower side panel of the lower treating apparatus. In this way, the upper treating apparatus and the lower treating apparatus may be insulated from each other.

As described above, the preferred implementations according to the present disclosure has been described in detail. However, a person with ordinary knowledge in the technical field to which the present disclosure belongs may implement the present disclosure in various modified manners without deviating from the scope and the spirit of the present disclosure defined in the appended claims. Therefore, the modifications of the implementations according to the present disclosure may fall into the scope of the present disclosure.

What is claimed is:

1. A stack-type laundry treating system comprising:
an upper treating apparatus including:
an upper cabinet including an upper base and an upper side panel,
a drying drum disposed in the upper cabinet and configured to rotate, the drying drum being configured to receive an object to be dried,
an upper driver disposed at the upper base and configured to rotate the drying drum,
an air flow passage configured to supply air to and discharge air from the drying drum, and
a heat exchanger configured to dehumidify and heat air that is supplied to and discharged from the drying drum; and
a lower treating apparatus including:
a lower cabinet including a lower top panel at which the upper base is mounted, the lower cabinet further including a lower side panel,
a tub disposed in the lower cabinet and configured to receive washing water,
a washing drum disposed inside the tub and configured to receive an object to be washed, and
a lower driver configured to rotate the washing drum,
wherein the upper side panel defines a side surface of the upper cabinet and includes a base support portion extending horizontally,
wherein the lower side panel defines a side surface of the lower cabinet and includes a lower horizontal bent portion extending inwardly of the lower cabinet from a top of the side surface of the lower cabinet, and
wherein the upper base includes a support protrusion that is made of a synthetic resin and that protrudes from an outer face located at a bottom portion of the upper base, the support protrusion being configured to be interposed between the base support portion and the lower horizontal bent portion to thereby (i) define a space between the upper side panel and the lower side panel, and (ii) electrically insulate and support the upper cabinet from the lower cabinet.

2. The system of claim 1,
wherein the support protrusion and the base support portion are configured to be sequentially seated on the lower horizontal bent portion in a vertical direction.

3. The system of claim 1, wherein the upper side panel includes an upper horizontal bent portion horizontally extending from a bottom of the upper side panel toward an inside of the upper treating apparatus, and wherein the support protrusion is disposed at an inside of the upper horizontal bent portion.

4. The system of claim 3, wherein the upper side panel further includes a vertical bent portion extending upward from an end of the upper horizontal bent portion, wherein the base support portion extends from an end of the vertical bent portion to an upper portion of the support protrusion, and wherein the support protrusion is positioned at the base support portion.

5. The system of claim 1, wherein the lower top panel has a support face that is interposed between the lower side panel and the support protrusion and supports the support protrusion.

6. The system of claim 5, wherein the support face of the lower top panel is disposed above the lower horizontal bent portion of the lower side panel.

7. The system of claim 6, wherein the upper side panel includes an upper horizontal bent portion horizontally extending from a bottom of the upper side panel toward an inside of the upper treating apparatus, and wherein the upper horizontal bent portion of the upper side panel and the lower horizontal bent portion of the lower side panel are spaced from each other by a first distance.

8. The system of claim 7, wherein a reinforcement frame is disposed at the top of the lower side panel, and wherein the reinforcement frame includes (i) a horizontal frame disposed at a top face of the lower horizontal bent portion and (ii) a vertical frame extending downward from an inner end of the horizontal frame.

9. The system of claim 8, wherein the horizontal frame of the reinforcement frame is located between the lower horizontal bent portion of the lower side panel and the support face of the lower top panel, and wherein the horizontal frame of the reinforcement frame and the upper horizontal bent portion of the upper side panel are spaced apart from each other by a second distance that is smaller than the first distance.

10. The system of claim 5, wherein the upper side panel further includes a vertical bent portion extending upward from an end of the upper horizontal bent portion, and wherein an outer end of the support face of the lower top panel is spaced apart from the vertical bent portion of the upper side panel.

11. The system of claim 10, wherein the support protrusion includes a guide protrusion protruding toward the lower top panel, and wherein the lower top panel defines a guide groove at a position corresponding to a position of the guide protrusion, wherein the guide protrusion is inserted into the guide groove.

12. The system of claim 11, wherein the guide groove of the lower top panel is positioned adjacent to the support face, is recessed downward, and extends in a front-rear direction, the guide groove being configured to guide the guide protrusion based on the upper treating apparatus being stacked on the lower treating apparatus.

13. The system of claim 11, wherein the guide protrusion of the support protrusion is one of a plurality of guide protrusions comprising:

a pair of front guide protrusions disposed at opposite sides of a front portion of a bottom face of the upper base; and a pair of rear guide protrusions disposed at opposite sides of a rear portion of the bottom face of the upper base.

14. The system of claim 13, wherein the guide groove of the lower top panel is one of a plurality of guide grooves comprising:

a pair of front guide grooves recessed at the lower top panel and corresponding to positions of the pair of front guide protrusions; and a pair of rear guide grooves recessed at the lower top panel and corresponding to positions of the pair of rear guide protrusions.

15. The system of claim 13, wherein at least one of the plurality of guide protrusions has:

a front guide face;

a front inclined face inclined upward from a front end of the front guide face toward the bottom face of the upper base; and a rear inclined face inclined upward from a rear end of the front guide face toward the bottom face of the upper base.

16. The system of claim 15, wherein the guide groove has:

a guide groove face;

a front inclined face inclined upward from a front end of the guide groove face toward a top face of the lower top panel; and a rear inclined face inclined upward from a rear end of the guide groove face toward the top face of the lower top panel.

17. The system of claim 16, wherein at least one of the pair of front guide protrusions has an auxiliary guide face that is positioned higher than the front guide face of the at least one of the pair of front guide protrusions.

18. The system of claim 16, wherein an outer edge of the front guide face of at least one of the plurality of guide protrusions has a curved face.

19. The system of claim 11, wherein the guide groove is made of a same metal plate as the lower top panel and integrally molded with the lower top panel using press molding.

20. The system of claim 11, wherein the support protrusion of the upper base extends outwardly from the outer face of the upper base, and the guide protrusion of the support protrusion extends downward from an end of the support protrusion.

21. The system of claim 1, wherein the support protrusion is made of a same material as the upper base and integrally molded with the upper base using injection molding.

* * * * *